US010311821B2

(12) United States Patent
Fu et al.

(10) Patent No.: US 10,311,821 B2
(45) Date of Patent: Jun. 4, 2019

(54) DATA DRIVER OF LIQUID CRYSTAL DISPLAY HAVING TWO INDIVIDUALLY REGULABLE GAMMA VOLTAGES

(71) Applicant: Shenzhen China Star Optoelectronics Technology Co., Ltd., Shenzhen, Guangdong (CN)

(72) Inventors: Wei Fu, Guangdong (CN); Yu Wu, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 285 days.

(21) Appl. No.: 15/304,518

(22) PCT Filed: Sep. 21, 2016

(86) PCT No.: PCT/CN2016/099509
§ 371 (c)(1),
(2) Date: Oct. 15, 2016

(87) PCT Pub. No.: WO2018/000592
PCT Pub. Date: Jan. 4, 2018

(65) Prior Publication Data

US 2018/0182343 A1 Jun. 28, 2018

(30) Foreign Application Priority Data

Jun. 30, 2016 (CN) ..... 2016 1 0495221

(51) Int. Cl.
*G09G 3/36* (2006.01)

(52) U.S. Cl.
CPC ..... *G09G 3/3685* (2013.01); *G09G 3/3607* (2013.01); *G09G 2300/0434* (2013.01);
(Continued)

(58) Field of Classification Search
CPC ..... G09G 3/3685; G09G 3/3607; G09G 2320/0219; G09G 2320/0276;
(Continued)

(56) References Cited

U.S. PATENT DOCUMENTS

2012/0127148 A1* 5/2012 Lee ..... G02F 1/134363 345/212
2014/0016049 A1* 1/2014 Yoshikaie ..... G02F 1/1313 349/15
(Continued)

FOREIGN PATENT DOCUMENTS

CN 1901020 A 1/2007
CN 101025486 A 8/2007
(Continued)

*Primary Examiner* — Ryan A Lubit
(74) *Attorney, Agent, or Firm* — Andrew C. Cheng

(57) ABSTRACT

The present invention provides a data driver of a liquid crystal display (LCD), which comprises: a digital-to-analog converter module; the digital-to-analog converter module receives data from a clock controller of LCD, and converts to generate pixel grayscale reference voltages; the digital-to-analog converter module receives first and second gamma voltages from a gamma circuit of the LCD, and generates the pixel grayscale voltages supplied to data lines of LCD in accordance with the pixel grayscale reference voltages and the first and second gamma voltages, and wherein the first and second gamma voltages can be regulated respectively. The present invention further provides a LCD, pixel grayscale voltages supplied to four-domain sub-pixels and eight-domain sub-pixels can be regulated respectively by arranging two gamma voltages which can be regulated respectively, so as to resolve the problem of color shift occurred when the LCD displays.

8 Claims, 3 Drawing Sheets

(52) U.S. Cl.
CPC ..... *G09G 2300/0452* (2013.01); *G09G 2310/027* (2013.01); *G09G 2320/0219* (2013.01); *G09G 2320/0242* (2013.01); *G09G 2320/0276* (2013.01); *G09G 2320/0673* (2013.01)

(58) Field of Classification Search
CPC ..... G09G 2320/0242; G09G 2310/027; G09G 2300/0452
See application file for complete search history.

(56) References Cited

U.S. PATENT DOCUMENTS

| | | | | |
|---|---|---|---|---|
| 2016/0027370 | A1 | 1/2016 | Lee | |
| 2016/0171953 | A1* | 6/2016 | Choe | G09G 3/20 345/204 |
| 2016/0217593 | A1* | 7/2016 | Huang | G09G 3/207 |
| 2017/0076694 | A1* | 3/2017 | Shin | G09G 3/2003 |

FOREIGN PATENT DOCUMENTS

| | | | |
|---|---|---|---|
| CN | 101221716 | A | 7/2008 |
| CN | 101458908 | A | 6/2009 |
| CN | 101458914 | A | 6/2009 |
| CN | 102201216 | A | 9/2011 |
| CN | 103456257 | A | 12/2013 |
| CN | 104808406 | A | 7/2015 |
| JP | 2013250545 | A | 12/2013 |

* cited by examiner

DATA DRIVER OF LIQUID CRYSTAL DISPLAY HAVING TWO INDIVIDUALLY REGULABLE GAMMA VOLTAGES

FIELD OF THE INVENTION

The present invention relates to a technology of liquid crystal display, and more particularly, to a liquid crystal display and a data driver thereof.

DESCRIPTION OF PRIOR ART

With the evolution of optoelectronic and semiconductor technology, and development of flat panel display becomes more and more popular. In many types of flat panel displays, Liquid Crystal Display (LCD) has been applied to all aspects of life because of it's a lot of superior characteristics such as high space efficiency, low power consumption, no radiation low electromagnetic interference, etc.

Currently, a LCD with a display type of vertical alignment has a problem of color shift in a large angle of view. In order to solve the problem of color shift, a low color shift (LCS) is designed for the display type of vertical alignment, but it will reduce the LCD transmittance. In order to solve the problem of reducing LCD transmittance, a single color LCS is further designed for LCD, i.e., the LCS is designed for one color sub-pixel of R sub-pixel, G sub-pixel and B sub-pixel in the LCD. Thus, LCD transmittance of LCS designed for one color sub-pixel is higher than LCD transmittance of LCS designed for all three color of sub-pixels, and also provide LCS effect.

However, color shift phenomenon will be occurred in low grayscale in this LCD. Let us take a LCD incorporated with a LCS design with B-sub-pixel as an example, design of B sub-pixel is different to design of R sub-pixel and design of G sub-pixel, so as their capacitive coupling effects are also different. Thus, B sub-pixel will be shift toward brighter or dimmer in the same grayscale, so as problem of color shift occurred when the LCD displays.

SUMMARY OF THE INVENTION

In order to solve deficiencies of prior art, the purpose of the present invention is to provide a data driver of a LCD, which comprises: a digital-to-analog converter module; the digital-to-analog converter module receives data from a clock controller of LCD, and converts to generate pixel grayscale reference voltages; the digital-to-analog converter module receives first and second gamma voltages from a gamma circuit of the LCD, and generates the pixel grayscale voltages supplied to data lines of LCD in accordance with the pixel grayscale reference voltages and the first and second gamma voltages, and wherein the first and second gamma voltages can be regulated respectively.

Further, the LCD comprises: a plurality of color sub-pixels is arranged in m-by-n array; the color sub-pixels are red or green or blue sub-pixels; in the row direction, the red sub-pixel, the green sub-pixel and the blue sub-pixel are arranged sequentially and repeatedly, in the column direction, common color sub-pixels are arranged repeatedly; any two of the red sub-pixel, the green sub-pixel and the blue sub-pixel are four-domain sub-pixels, and the rest one is an eight-domain sub-pixel; the plurality (n) data lines are arranged along the column direction, and color sub-pixels arranged in each column connected to a corresponding data line; wherein the data lines connected to four-domain sub-pixels receive the pixel grayscale voltages generated by the digital-to-analog converter module in accordance with the pixel grayscale reference voltages and the first gamma voltages, and the data lines connected to eight-domain sub-pixels receive the pixel grayscale voltages generated by the digital-to-analog converter module in accordance with the pixel grayscale reference voltages and the second gamma voltages.

Further, the LCD comprises: a plurality of color sub-pixels is arranged in m-by-n array; the color sub-pixels are red or green or blue sub-pixels; in the row direction, the red sub-pixel, the green sub-pixel and the blue sub-pixel are arranged sequentially and repeatedly, in the column direction, common color sub-pixels are arranged repeatedly, any two of the red sub-pixel, the green sub-pixel and the blue sub-pixel are four-domain sub-pixels, and the rest one is an eight-domain sub-pixel; the plurality (n) data lines are arranged along the column direction, and color sub-pixels are arranged in each column connected to two corresponding and adjacent data lines alternately, wherein a data line only to be connected to four-domain sub-pixels is a first data line and a data line connected to four-domain sub-pixels and eight-domain sub-pixels is a second data line; the first data lines receive the pixel grayscale voltages generated by the digital-to-analog converter module in accordance with the pixel grayscale reference voltages and the first gamma voltages; and the second data lines receive the pixel grayscale voltages from the digital-to-analog converter module and which is generated from the pixel grayscale reference voltage and the first or second gamma voltage, based on whether the second data line connected to the four-domain pixels or the eight-domain pixels.

Further, when the second data lines supply pixel grayscale voltages to the four-domain sub-pixels connected to thereof, the second data lines receive the pixel grayscale voltages generated by the digital-to-analog converter module in accordance with the pixel grayscale reference voltages and the first gamma voltages; when the second data lines supply pixel grayscale voltages to the eight-domain sub-pixels connected to thereof, the second data lines receive the pixel grayscale voltages generated by the digital-to-analog converter module in accordance with the pixel grayscale reference voltages and the second gamma voltages.

Further, the data driver further comprises: a switching signal generating module is used to generate a switching signal to switch the first and second gamma voltages, when the second data lines supply pixel grayscale voltages to the four or eight-domain sub-pixels; wherein when the second data lines supply pixel grayscale voltages to the four-domain sub-pixels connected to thereof, the switching signal generating module generates a switching signal to switch the second gamma voltages to the first gamma voltages, the digital-to-analog converter module receives the first gamma voltages and generate pixel grayscale voltages in accordance with the pixel grayscale reference voltages and the first gamma voltages; and wherein when the second data lines supply pixel grayscale voltages to the eight-domain sub-pixels connected to thereof, the switching signal generating module generates a switching signal to switch the first gamma voltages to the second gamma voltages, the digital-to-analog converter module receives the second gamma voltages and generate pixel grayscale voltages in accordance with the pixel grayscale reference voltages and the second gamma voltages.

Another purpose of the present invention is to provide a data driver of a LCD, which comprises: a plurality (n) data lines is arranged along the column direction; a plurality of color sub-pixels is arranged in m-by-n array, and which arranged in each column are connected to a corresponding data line; a data driver, which comprises a digital-to-analog converter module, the digital-to-analog converter module receives data from a clock controller of LCD, and converts to generate pixel grayscale reference voltages, the digital-to-analog converter module receives first and second gamma voltages from a gamma circuit of the LCD, and generates the pixel grayscale voltages supplied to data lines of LCD in accordance with the pixel grayscale reference voltages and the first and second gamma voltages, and the first and second gamma voltages can be regulated respectively.

Advantages of the present invention: pixel grayscale voltages supplied to four-domain sub-pixels and eight-domain sub-pixels can be regulated respectively by arranging two gamma voltages which can be regulated respectively, so as to resolve the problem of color shift occurred when the LCD displays.

BRIEF DESCRIPTION OF DRAWINGS

Technical implementation will be described below clearly and fully by combining with drawings made in accordance with an embodiment in the present invention.

DESCRIPTION OF PREFERRED EMBODIMENT

Technical implementation will be described below clearly and fully by combining with drawings made in accordance with an embodiment in the present invention. Obviously, the described embodiments are merely part of embodiment of the present invention, not at all. Based on the embodiments of the present invention, on the premise of embodiments in the absence of creative work, all other embodiments are in the scope of protection in the present invention.

Figure 1:
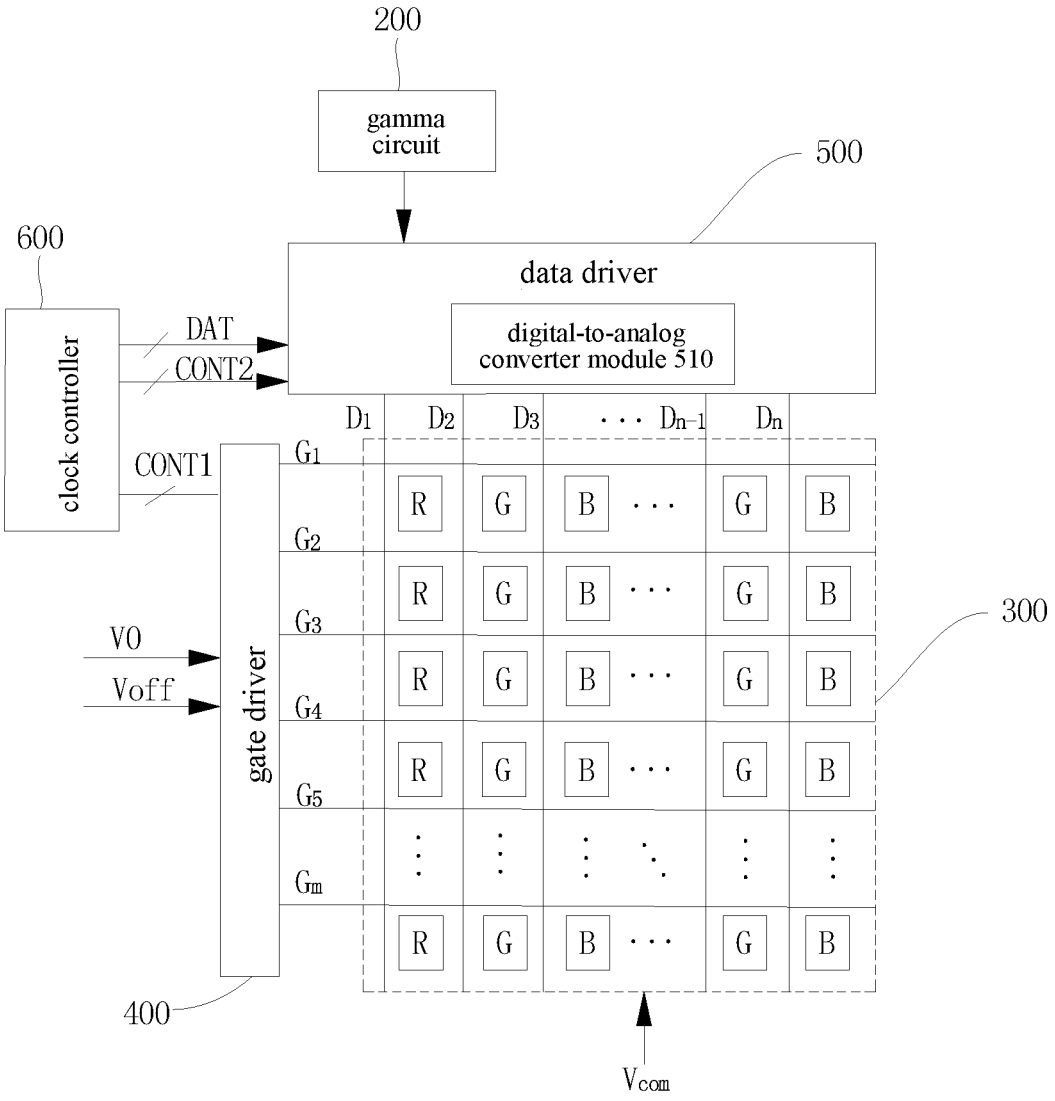
FIG. 1 is an illustrational view of the LCD in accordance with the embodiment of the present invention.

FIG. 1 is an illustrational view of the LCD in accordance with the embodiment of the present invention.

Referring FIG. 1, the LCD in accordance with the embodiment of the present invention comprises: a LCD panel component 300; a gate driver 400 and a data driver 500, both are connected to the LCD panel component 300; a clock controller 600, which is used to control the LCD panel component 300, the gate driver 400 and the data driver 500; a gamma circuit 200, which is used to generate a first and a second gamma voltages to supply to the data driver 500, and wherein the first and second gamma voltages can be regulated respectively.

The LCD panel component 300 comprises a plurality of display signal lines and a plurality of color sub-pixels is arranged in m-by-n array which is connected to the display signal lines, i.e., the total number of the color sub-pixels is to multiply m by n. The LCD panel component 300 can comprise: a lower display panel and an upper display panel opposite to each other, both are not shown in figure, and a liquid crystal layer is inserted between the lower display panel and the upper display panel, which is not shown in figure. Herebelow, the color sub-pixels can be red sub-pixels R, blue sub-pixels B or green sub-pixels G, but it shall not be construed as a limitation to the present invention.

Display data lines can be arranged on the lower display panel, which can comprise a plurality of gate lines $G_1$ to $G_m$ for transmitting gate signals and a plurality of data lines $D_1$ to $D_n$ for transmitting data signals. The gate lines $G_1$ to $G_m$ are arranged extending to the row direction, and which are substantially parallel to each other. The data lines $D_1$ to $D_n$ are arranged extending to the column direction, and which are substantially parallel to each other.

Each color sub-pixel comprises: a switching device connected to the corresponding gate lines and data lines; and a liquid crystal capacitor connected to the switching device. If necessary, each color sub-pixel can also comprise a storage capacitor connected to the liquid crystal capacitor in parallel.

Each switching device of color sub-pixel is a three-terminal device, therefore it has a controlling terminal connected to the corresponding gate line, an input connected to the corresponding data line and an output connected to the corresponding liquid crystal capacitor.

The gate driver 400 is connected to the gate lines $G_1$ to $G_m$, and supplies gate signals to the gate lines $G_1$ to $G_m$. The gate signal is a combination of a gate-on voltage V0 and a cut-off voltage Voff supplied to the gate driver 400 from an external source. Referring to FIG. 1, arranging one of the gate driver 400 on one side of the LCD panel component 300, and the gate lines $G_1$ to $G_m$ are connected to the gate driver 400. However, it is not limited in the present invention, i.e., it can arrange two gate drivers on opposite sides of the LCD panel component 300 respectively, and both the gate lines $G_1$ to $G_m$ are connected to each of the two gate drivers.

The data driver 500 is connected to the data lines $D_1$ to $D_n$ of the LCD panel component 300 and supplies pixel grayscale voltages to the color sub-pixels. A clock controller 600 controls to operate the gate driver 400 and data driver 500.

The clock controller 600 receives input image signals from an external graphics controller (not shown in figure) and a plurality of input controlling signals used to control the input image signals to display. The clock controller 600 processes the input image signals appropriately in accordance with the controlling signals, so as to generate data DAT which are meet to operating conditions of the LCD panel component 300 to generate pixel grayscale reference voltages. Then the clock controller 600 generates gate controlling signals and data controlling signals, and transmits the gate controlling signals to each of the gate driver 400, and transmits the data controlling signals and the data DAT which generates the pixel grayscale reference voltages to the data driver 500.

The gate control signal CONT1 may comprise: scan start signals for operating the gate driver 400, i.e., a scanning operation; and at least one of pixel clock signal for controlling when to output the gate-on voltage V0. The gate control signals CONT1 may also comprise outputting an enable signal for regulating duration of the gate-on voltage V0.

The data controlling signal CONT2 may comprise: a horizontal sync start signal for indicating transmission the data DAT which generates the pixel grayscale reference voltages; a load signal for requesting to supply pixel grayscale voltages corresponding to the data DAT which generates the pixel grayscale reference voltages to the gate lines $G_1$ to $G_m$; and a data clock signal. The data controlling signal CONT2 may also comprise an inverted signal for inverting the polarity of the pixel grayscale voltages with respect to common voltages Vcom.

The data driver 500 comprises: a digital-to-analog converter module 510. The digital-to-analog converter module 510 receives the data DAT from the clock controller 600 in response to the data controlling signal CONT2, and converts the data DAT which generates the pixel grayscale reference voltages to the pixel grayscale reference voltages. The data driver 500 receives the first and second gamma voltages from the gamma circuit 200 in response to the data controlling signal CONT2, and generates the pixel grayscale voltages in accordance with the pixel grayscale reference voltages and the first and second gamma voltages. Then the data driver 500 supplies data voltages to the data lines $D_1$ to $D_n$.

The arrangement of the liquid crystal molecules varies depending on magnitude of pixel grayscale voltages, because of the polarity of light transmitted through a liquid crystal layer can also vary, resulting in the changes of the transmittance of the liquid crystal layer Illustration and elaboration will be given herebelow in view of how the interconnections between different color sub-pixels and the data lines supply the pixel grayscale voltages to the data lines in accordance with the data driver 500 made according to the present invention.

Figure 2:
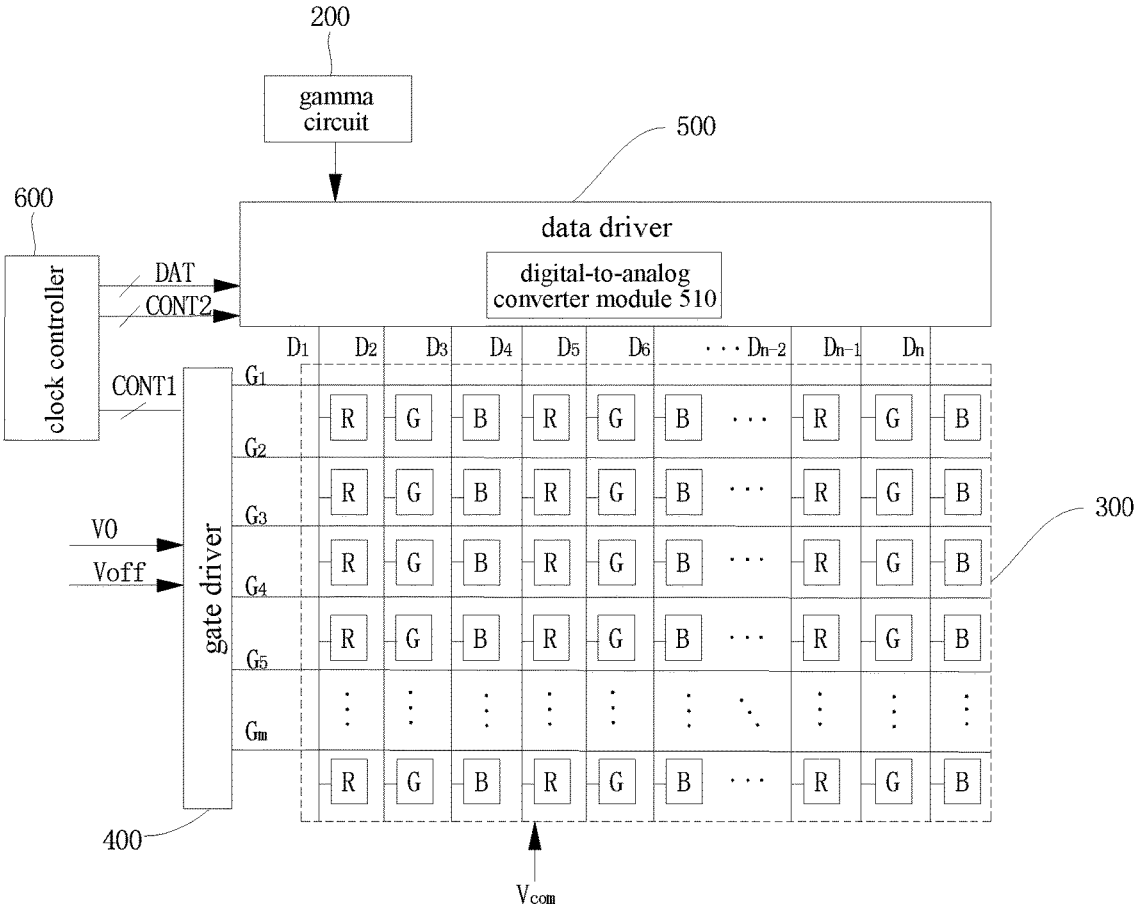
FIG. 2 is an illustrational view of the connecting of color sub-pixels and data lines in accordance with the embodiment of the present invention.

FIG. 2 is an illustrational view of the connecting of color sub-pixels and data lines in accordance with the embodiment of the present invention.

Referring to FIG. 2, the LCD panel component 300 comprises a plurality of color sub-pixels is arranged in m-by-n array which is connected to the display signal lines, i.e., the total number of the color sub-pixels is to multiply m by n. Herebelow, the color sub-pixels can be red sub-pixels R, blue sub-pixels B or green sub-pixels G, but it shall not be construed as a limitation to the present invention.

In the row direction, the red sub-pixel R, the green sub-pixel G and the blue sub-pixel B are arranged sequentially and repeatedly; in the column direction, common color sub-pixels are arranged repeatedly, i.e., common color sub-pixel can be the red sub-pixel R, the blue sub-pixel B and the green sub-pixel G.

Any two of the red sub-pixel R, the green sub-pixel G and the blue sub-pixel B are four-domain sub-pixels, and the rest one is an eight-domain sub-pixel. In the embodiment of the present invention, the red sub-pixel R and the green sub-pixel G are four-domain sub-pixels and the blue sub-pixel B is an eight-domain sub-pixel.

The interconnections between the m-by-n array sub-pixels and the $D_1$ to $D_n$ data lines are facilitated by normal pixel configuration, i.e., common colors in each column are interconnected to the corresponding data line $D_j$, wherein 1«j«n.

The data lines $D_1, D_2, D_4, D_5, \ldots, D_{n-2}, D_{n-1}$ connected to four-domain sub-pixels (i.e., the red sub-pixel R and the green sub-pixel G) receive the pixel grayscale voltages generated by the digital-to-analog converter module 510 in accordance with the pixel grayscale reference voltages and the first gamma voltages; and the data lines $D_3, D_6, \ldots, D_n$ connected to eight-domain sub-pixels (i.e., the blue sub-pixel B) receive the pixel grayscale voltages generated by the digital-to-analog converter module 510 in accordance with the pixel grayscale reference voltages and the second gamma voltages.

Figure 3:
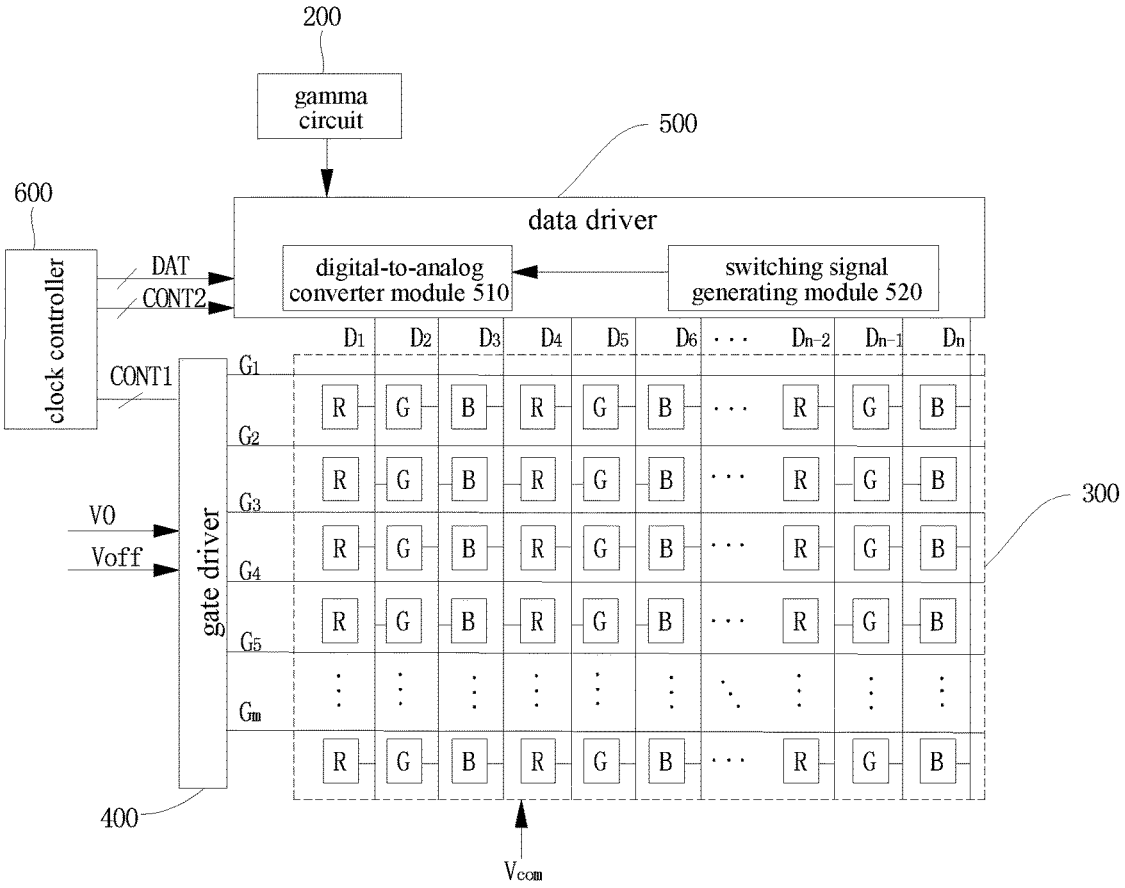
FIG. 3 is a further illustrational view of the connecting of color sub-pixels and data lines and a block diagram of a data driver of in accordance with the embodiment of the present invention.

FIG. 3 is a further illustrational view of the connecting of color sub-pixels and data lines and a block diagram of a data driver of in accordance with the embodiment of the present invention.

Referring to FIG. 3, the LCD panel component 300 comprises a plurality of color sub-pixels is arranged in m-by-n array which is connected to the display signal lines, i.e., the total number of the color sub-pixels is to multiply m by n. Herebelow, the color sub-pixels can be red sub-pixels R, blue sub-pixels B or green sub-pixels G, but it shall not be construed as a limitation to the present invention.

In the row direction, the red sub-pixel R, the green sub-pixel G and the blue sub-pixel B are arranged sequentially and repeatedly; in the column direction, the same color sub-pixels are arranged repeatedly, i.e., the same color sub-pixel can be the red sub-pixel R, the blue sub-pixel B and the green sub-pixel G.

Any two of the red sub-pixel R, the green sub-pixel G and the blue sub-pixel B are four-domain sub-pixels, and the rest one is an eight-domain sub-pixel. In the embodiment of the present invention, the red sub-pixel R and the green sub-pixel G are four-domain sub-pixels and the blue sub-pixel B is an eight-domain sub-pixel.

The interconnections between the m-by-n array sub-pixels and the $D_1$ to $D_n$ data lines are facilitated by flip pixel configuration, i.e., common colors in each column are interconnected to two of the corresponding and adjacent data line $D_{j-1}$ and $D_j$, wherein 1«j«n.

Data lines only to be connected to four-domain sub-pixels (i.e., the red sub-pixel R and/or the green sub-pixel G) are data lines $D_1, D_4, D_7, \ldots, D_{n-2}$, and the data lines $D_1, D_4, D_7, \ldots, D_{n-2}$ receive the pixel grayscale voltages generated by the digital-to-analog converter module 510 in accordance with the pixel grayscale reference voltages and the first gamma voltages.

Data lines connected to four-domain sub-pixels and eight-domain sub-pixels (i.e., a data line is connected to the red sub-pixel R and the blue sub-pixel B, and a data line is connected to the green sub-pixel G and the blue sub-pixel B) are data lines $D_2, D_3, D_5, D_6, \ldots, D_{n-1}, D_n$, and the data lines $D_2, D_3, D_5, D_6, \ldots, D_{n-1}, D_n$ receive the pixel grayscale voltages from the digital-to-analog converter module 510 and which is generated from the pixel grayscale reference voltage and the first or second gamma voltage, based on whether the second data line connected to the four-domain pixels or the eight-domain pixels.

Specifically, when the data lines $D_2, D_3, D_5, D_6, \ldots, D_{n-1}, D_n$ supply pixel grayscale voltages to the four-domain sub-pixels connected to thereof, the data lines $D_2, D_3, D_5, D_6, \ldots, D_{n-1}, D_n$ receive the pixel grayscale voltages generated by the digital-to-analog converter module 510 in accordance with the pixel grayscale reference voltages and the first gamma voltages; when the data lines $D_2, D_3, D_5, D_6, \ldots, D_{n-1}, D_n$ supply pixel grayscale voltages to the eight-domain sub-pixels connected to thereof, the data lines $D_2, D_3, D_5, D_6, \ldots, D_{n-1}, D_n$ receive the pixel grayscale voltages generated by the digital-to-analog converter module in accordance with the pixel grayscale reference voltages and the second gamma voltages.

In order to achieve switching between the first and the second gamma voltages, referring to FIG. 3, the data driver 500 further comprises: a switching signal generating module 520 is used to generate a switching signal to switch the first and second gamma voltages, when the data lines $D_2, D_3, D_5, D_6, \ldots, D_{n-1}, D_n$ supply pixel grayscale voltages to the four or eight-domain sub-pixels Referring to FIG. 3, in connection with the data lines $D_1, D_4, D_7, \ldots, D_{n-2}$, when the data lines $D_1, D_4, D_7, \ldots, D_{n-2}$ supply the pixel grayscale reference voltages to color sub-pixels of odd-rows or even-rows, the data lines $D_1, D_4, D_7, \ldots, D_{n-2}$ receive the pixel grayscale voltages generated by the digital-to-analog converter module 510 in accordance with the pixel grayscale reference voltages and the first gamma voltages and the generated pixel grayscale voltages is supplied to the red sub-pixel R.

In connection with the data lines $D_2, D_5, D_8, \ldots, D_{n-1}$, when the data lines $D_2, D_5, D_8, \ldots, D_{n-1}$ supply the pixel grayscale reference voltages to color sub-pixels of odd-rows, the switching signal generating module 520 generates a switching signal to switch the second gamma voltages to the first gamma voltages, the data lines $D_2, D_5, D_8, \ldots, D_{n-1}$ receive the pixel grayscale voltages generated by the digital-to-analog converter module 510 in accordance with the pixel grayscale reference voltages and the first gamma voltages and the generated pixel grayscale voltages is supplied to the red sub-pixel G; when the data lines $D_2, D_5, D_8, \ldots, D_{n-1}$ supply the pixel grayscale reference voltages to color sub-pixels of even-rows, the switching signal generating module 520 generates a switching signal to switch the first gamma voltages to the second gamma voltages, the data lines $D_2, D_5, D_8, \ldots, D_{n-1}$ receive the pixel grayscale voltages generated by the digital-to-analog converter module 510 in accordance with the pixel grayscale reference voltages and the first gamma voltages and the generated pixel grayscale voltages is supplied to the red sub-pixel B.

In connection with the data lines $D_3, D_6, D_9, \ldots, D_n$, when the data lines $D_3, D_6, D_9, \ldots, D_n$ supply the pixel grayscale reference voltages to color sub-pixels of odd-rows, the switching signal generating module 520 generates a switching signal to switch the second gamma voltages to the first gamma voltages, the data lines $D_3, D_6, D_9, \ldots, D_n$ receive the pixel grayscale voltages generated by the digital-to-analog converter module 510 in accordance with the pixel grayscale reference voltages and the first gamma voltages and the generated pixel grayscale voltages is supplied to the red sub-pixel B; when the data lines $D_3, D_6, D_9, \ldots, D_n$ supply the pixel grayscale reference voltages to color sub-pixels of even-rows, the switching signal generating module 520 generates a switching signal to switch the first gamma voltages to the second gamma voltages, the data lines data lines $D_3, D_6, D_9, \ldots, D_n$ receive the pixel grayscale voltages generated by the digital-to-analog converter module 510 in accordance with the pixel grayscale reference voltages and the first gamma voltages and the generated pixel grayscale voltages is supplied to the red sub-pixel R.

In summary, pixel grayscale voltages supplied to four-domain sub-pixels and eight-domain sub-pixels can be regulated respectively by arranging two gamma voltages which can be regulated respectively, so as to resolve the problem of color shift occurred when the LCD displays.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

The invention claimed is:

1. A data driver of liquid crystal display, which comprises a digital-to-analog converter;

wherein the digital-to-analog converter receives data from a clock controller of a liquid crystal display, for conversion into pixel grayscale reference voltages;

wherein the digital-to-analog converter receives first and second gamma voltages from a gamma circuit of the liquid crystal display and generates pixel grayscale voltages that are supplied to data lines of the liquid crystal display in accordance with the pixel grayscale reference voltages and the first and second gamma voltages, wherein the first and second gamma voltages are regulable respectively;

wherein the liquid crystal display comprises a plurality of color sub-pixels arranged in an array having a first number of rows and a second number of columns, the color sub-pixels having colors of red, green, and blue, which are respectively red, green, and blue sub-pixels;

wherein in a row direction, the red sub-pixels, the green sub-pixels, and the blue sub-pixels are arranged sequentially and repeatedly, and in a column direction, colors sub-pixels of a same color are arranged repeatedly, and wherein the sub-pixels of two of the colors are sub-pixels of a first domain and the sub-pixels of a remaining one of the colors are sub-pixels of a second domain;

wherein a second number of data lines extend in the column direction and respectively correspond to the second number of columns;

wherein each of the data lines that is connected to the sub-pixels of the first domain receives the pixel grayscale voltages generated by the digital-to-analog converter in accordance with the pixel grayscale reference voltages and the first gamma voltages, and each of the data lines that is connected to the sub-pixels of the second domain receives the pixel grayscale voltages generated by the digital-to-analog converter in accordance with the pixel grayscale reference voltages and the second gamma voltages.

2. The data driver as recited in claim 1, wherein the color sub-pixels arranged in each of the columns are connected to the data line corresponding to the column.

3. The data driver as recited in claim 1, wherein the data lines comprises first data lines and second data lines, the first data lines being connected to the sub-pixels of the first domain only and the second data lines being connected to the sub-pixels of the first domain and the sub-pixels of the second domain;

wherein the first data lines receive the pixel grayscale voltages generated by the digital-to-analog converter in accordance with the pixel grayscale reference voltages and the first gamma voltage; and wherein the second data lines receives the pixel grayscale voltages generated by the digital-to-analog converter in accordance with the pixel grayscale reference voltages and the first or second gamma voltages, based on whether the second data lines are connected to the sub-pixels of the first domain or the sub-pixels of the second domain, such that when the second data lines supply pixel grayscale voltages to the sub-pixels of the first domain connected thereto, the second data lines receive the pixel grayscale voltages generated by the digital-to-analog converter in accordance with the pixel grayscale reference voltages and the first gamma voltages; and when the second data lines supply pixel grayscale voltages to the sub-pixels of the second domain connected thereto, the second data lines receive the pixel grayscale voltages generated by the digital-to-analog converter in accordance with the pixel grayscale reference voltages and the second gamma voltages.

4. The data driver as recited in claim 3, wherein the data driver further comprises:

a switching signal that switches between the first and second gamma voltages;

wherein when the second data lines supply pixel grayscale voltages to the sub-pixels of the first domain connected thereto, the switching signal switches to the first gamma voltages, so that the digital-to-analog converter receives the first gamma voltages and generates pixel grayscale voltages in accordance with the pixel grayscale reference voltages and the first gamma voltages, and wherein the second data lines supply pixel grayscale voltages to the sub-pixels of the second domain connected thereto, the switching signal switches to the second gamma voltages, so that the digital-to-analog converter receives the second gamma voltages and generate pixel grayscale voltages in accordance with the pixel grayscale reference voltages and the second gamma voltages.

5. A liquid crystal display, comprising:

a plurality of color sub-pixels arranged in an array having a first number of rows and a second number of columns, each of the color sub-pixels being connected to one of a second number of data lines that extend in a column direction and respectively correspond to the second number of columns; and a data driver, which comprises a digital-to-analog converter, which receives data from a clock controller, for conversion into pixel grayscale reference voltages, the digital-to-analog converter further receiving first and second gamma voltages from a gamma circuit of the liquid crystal display and generating pixel grayscale voltages that are supplied to the data lines in accordance with the pixel grayscale reference voltages and the first and second gamma voltages, wherein the first and second gamma voltages are regulable respectively;

wherein the color sub-pixels have colors of red, green, and blue, which are respectively red, green, and blue sub-pixels, and wherein the sub-pixels of two of the colors are sub-pixels of a first domain and the sub-pixels of a remaining one of the colors are sub-pixels of a second domain;

wherein in a row direction, the red sub-pixels, the green sub-pixels, and the blue sub-pixels are arranged sequentially and repeatedly, and in the column direction, colors sub-pixels of a same color are arranged repeatedly;

wherein each of the data lines that is connected to the sub-pixels of the first domain receives the pixel grayscale voltages generated by the digital-to-analog converter in accordance with the pixel grayscale reference voltages and the first gamma voltages, and each of the data lines that is connected to the sub-pixels of the second domain receives the pixel grayscale voltages generated by the digital-to-analog converter in accordance with the pixel grayscale reference voltages and the second gamma voltages.

6. The liquid crystal display as recited in claim 5, wherein, wherein the color sub-pixels arranged in each of the columns are connected to the data line corresponding to the column.

7. The data driver as recited in claim 5, wherein the data lines comprises first data lines and second data lines, the first data lines being connected to the sub-pixels of the first domain only and the second data lines being connected to the sub-pixels of the first domain and the sub-pixels of the second domain;

wherein the first data lines receive the pixel grayscale voltages generated by the digital-to-analog converter in accordance with the pixel grayscale reference voltages and the first gamma voltage; and wherein the second data lines receives the pixel grayscale voltages generated by the digital-to-analog converter in accordance with the pixel grayscale reference voltages and the first or second gamma voltages, based on whether the second data lines are connected to the sub-pixels of the first domain or the sub-pixels of the second domain, such that when the second data lines supply pixel grayscale voltages to the sub-pixels of the first domain connected thereto, the second data lines receive the pixel grayscale voltages generated by the digital-to-analog converter in accordance with the pixel grayscale reference voltages and the first gamma voltages; and when the second data lines supply pixel grayscale voltages to the sub-pixels of the second domain connected thereto, the second data lines receive the pixel grayscale voltages generated by the digital-to-analog converter in accordance with the pixel grayscale reference voltages and the second gamma voltages.

8. The data driver as recited in claim 7, wherein the data driver further comprises:

a switching signal that switches between the first and second gamma voltages;

wherein when the second data lines supply pixel grayscale voltages to the sub-pixels of the first domain connected thereto, the switching signal switches to the first gamma voltages, so that the digital-to-analog converter receives the first gamma voltages and generates pixel grayscale voltages in accordance with the pixel grayscale reference voltages and the first gamma voltages, and wherein the second data lines supply pixel grayscale voltages to the sub-pixels of the second domain connected thereto, the switching signal switches to the second gamma voltages, so that the digital-to-analog converter receives the second gamma voltages and generate pixel grayscale voltages in accordance with the pixel grayscale reference voltages and the second gamma voltages.

* * * * *